US008225425B2

(12) United States Patent
Polucha et al.

(10) Patent No.: US 8,225,425 B2
(45) Date of Patent: Jul. 24, 2012

(54) NOISEMAKER APPARATUS

(75) Inventors: James Polucha, Odenton, MD (US); Marc Kohn, Silver Spring, MD (US)

(73) Assignee: FANtrepreneur LLC, Falls Church, VA (US)

( * ) Notice: Subject to any disclaimer, the term of this patent is extended or adjusted under 35 U.S.C. 154(b) by 737 days.

(21) Appl. No.: 11/902,516

(22) Filed: Sep. 21, 2007

(65) Prior Publication Data

US 2009/0077712 A1 Mar. 26, 2009

(51) Int. Cl.
*A41D 19/00* (2006.01)

(52) U.S. Cl. ..... 2/160; 446/26

(58) Field of Classification Search ..... 2/20, 21, 2/160; 446/26, 81, 397, 421, 486
See application file for complete search history.

(56) References Cited

U.S. PATENT DOCUMENTS 2,845,628 A * 8/1958 Dell ..... 2/20
3,203,006 A 8/1965 Shirey
3,444,772 A * 5/1969 Martin ..... 84/402
3,490,410 A 1/1970 Crawford, Sr.
4,127,053 A 11/1978 Cohen
4,300,307 A 11/1981 Biasuzzi et al.
D280,053 S 8/1985 Singer
4,577,625 A * 3/1986 Lohati et al. ..... 601/128
4,635,516 A 1/1987 Giannini
4,658,694 A * 4/1987 Marks et al. ..... 84/402
4,850,052 A 7/1989 Matthews
5,067,478 A * 11/1991 Berlant ..... 601/15
5,177,467 A 1/1993 Chung-Piao
5,345,611 A 9/1994 Smith, Jr.
D364,653 S 11/1995 Boden
D369,388 S 4/1996 Gilbert, Jr. et al.
D372,744 S 8/1996 Potrzuski
5,551,083 A * 9/1996 Goldsmith ..... 2/19
D375,328 S 11/1996 Gilbert, Jr. et al.
D376,181 S 12/1996 Gilbert, Jr. et al.
D378,384 S 3/1997 Gilbert, Jr. et al.
D390,887 S 2/1998 Gilbert, Jr. et al.
D405,479 S 2/1999 Loob
6,108,817 A 8/2000 Kostelac
6,182,293 B1 * 2/2001 Mustin ..... 2/161.1
6,223,353 B1 * 5/2001 Lardieri, Jr. ..... 2/161.1
6,422,908 B1 7/2002 Kuracina et al.
6,506,092 B1 1/2003 Kuracina et al.
6,604,244 B1 8/2003 Leach
6,736,695 B1 5/2004 Hoch
6,817,922 B1 11/2004 Davies
D500,909 S 1/2005 Luciano et al.
D512,811 S 12/2005 Luciano et al.
D515,280 S 2/2006 Luciano et al.
D515,281 S 2/2006 Luciano et al.

(Continued)

OTHER PUBLICATIONS www.hometeamhandz.com, 2010, pp. 1-4.*

*Primary Examiner* — Katherine Moran
(74) *Attorney, Agent, or Firm* — Shlesinger, Arkwright & Garvey LLP

(57) ABSTRACT

A noisemaking device comprising a first and second holders in the form of, for example, a pair of gloves, the palm region of each glove is provided with a domed shaped hollow member formed of a rigid, sound transmitting material and which extends upwardly from the surface of the holder so that when the hollow members are caused to be impacted against each other during hand clapping, a distinct sound is generated.

18 Claims, 2 Drawing Sheets

U.S. PATENT DOCUMENTS 7,001,238 B1 2/2006 Gonzalez
7,038,575 B1 5/2006 Frohman et al.
7,146,648 B1 * 12/2006 Kessee ..... 2/160
7,544,138 B2 * 6/2009 Weber et al. ..... 473/450
7,582,030 B2 * 9/2009 LaPergola ..... 473/450
2004/0157525 A1 * 8/2004 Epstein ..... 446/220
2005/0155134 A1 7/2005 McLin
2009/0100572 A1 * 4/2009 Jones ..... 2/160

* cited by examiner

FIG. 2
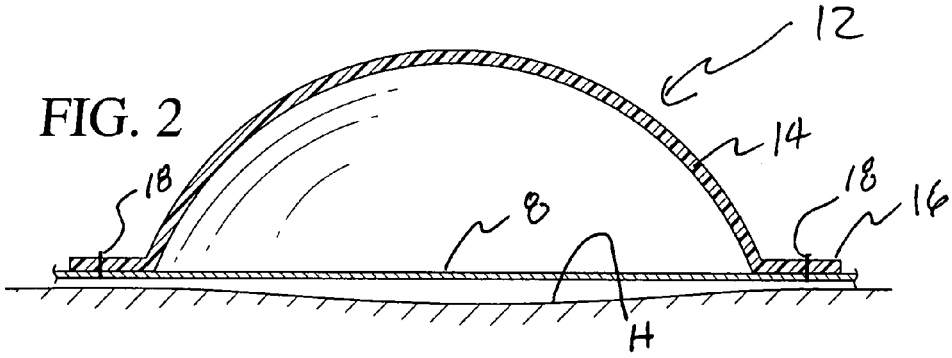
FIG. 3
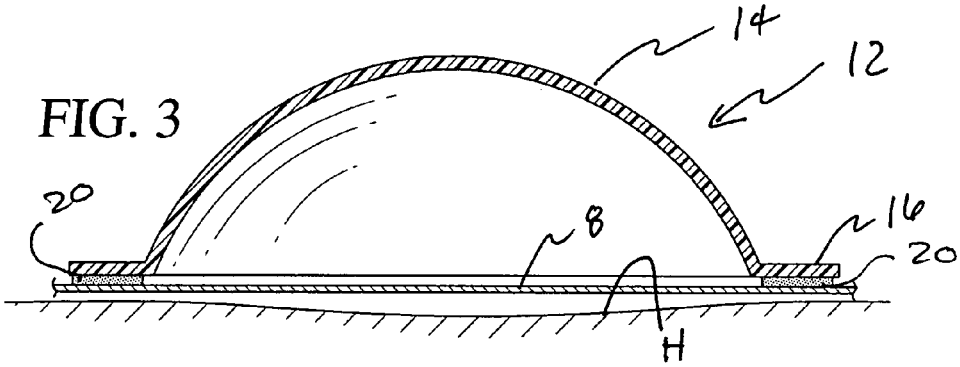
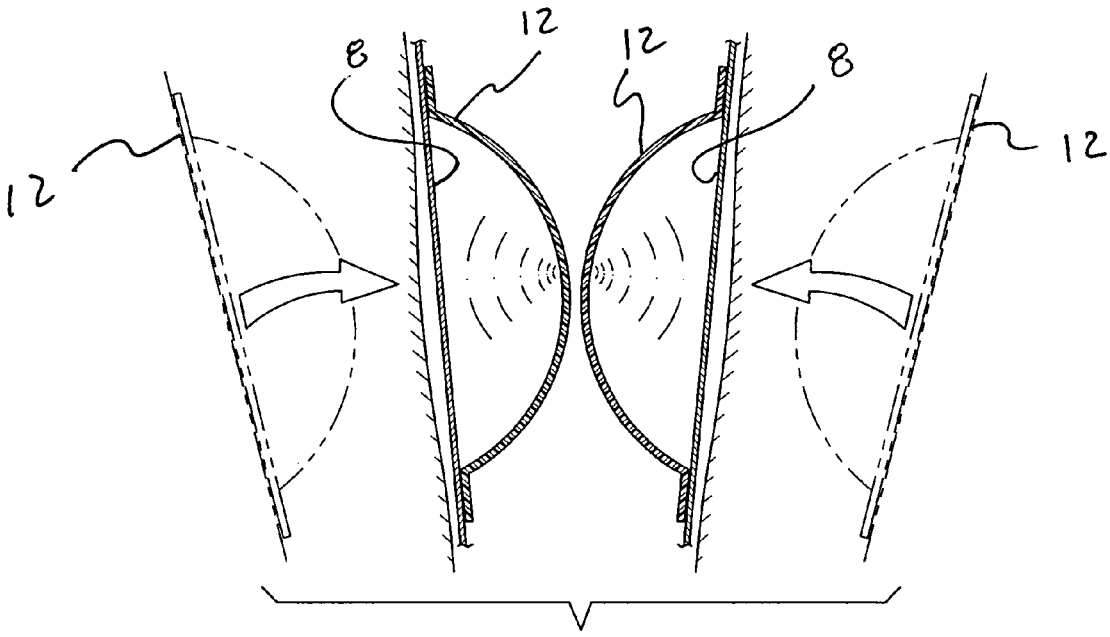
FIG. 4

NOISEMAKER APPARATUS

FIELD OF THE INVENTION

The invention is a noisemaking device that is attached to the hands so that when the hands are clapped together, a distinct and loud sound is produced. It is particularly suited for spectators at a sporting event.

BACKGROUND OF THE INVENTION

During sporting events such as football, baseball and hockey games, it is not uncommon for spectators to express their pleasure by clapping hands or applauding. Hand clapping is also done to distract or intimidate an opposing team during key moments of a game. In that situation, is it desirable to generate the loudest sound possible. Although the volume of noise generated by hand clapping can be large, it is mitigated by several factors.

For example, repeated and intense applause can lead to fatigue and a reduction in the volume and intensity of subsequent applause. Vigorous hand clapping is difficult to maintain for an extended length of time. During the winter months, gloves or mittens mute the applause. In addition, the physiology of a spectator's hand affects the quality of the applause. A young child cannot generate an applause that is as loud as that of an adult.

BRIEF SUMMARY OF THE INVENTION

The present invention is a noisemaking device comprising a first and second holders in the form of, for example, a pair of gloves, the palm region of each glove is provided with a hollow member of rigid construction and which extending upwardly from the surface of the glove so that when said hollow members are caused to be impacted against each other during hand clapping, a distinct sound is caused to be generated.

BRIEF DESCRIPTION OF THE SEVERAL VIEWS OF THE DRAWINGS

FIG. 2 is an enlarged sectional view taken along lines 2-2 of FIG. 1;

FIG. 3 is an another embodiment of the invention illustrated in FIG. 2; and FIG. 4 illustrates the manner in which the hollow members impact against each other during hand clapping.

DETAILED DESCRIPTION OF THE INVENTION

Figure 1:
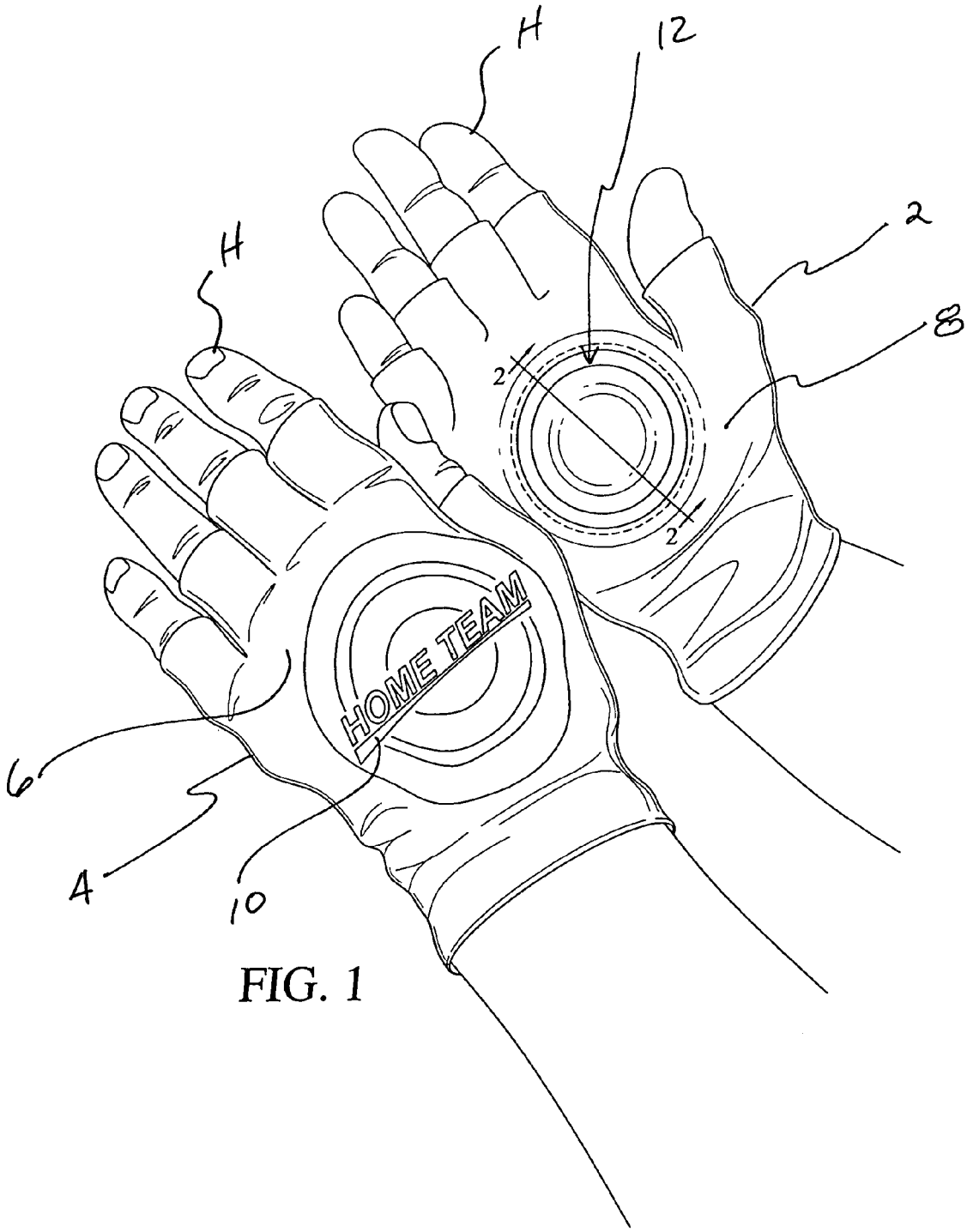
FIG. 1 is an elevation showing the noisemaking device of the present invention when worn by a user.

FIG. 1 illustrates a pair of hands H which are fitted with the noisemaking device according to the present invention. The noisemaking device can be seen to comprise a pair of holders 2 and 4 that are shown in the drawing to be a pair of gloves. As is apparent, it is within the scope of the present invention to provide the pair of holders in a form other than gloves. For example, a pair of elastic straps that are adapted to receive a separate one of each hand could be provided.

Each of gloves 2 and 4 include a back region 6 and a palm region 8. The back region 6 of glove 4 is further provided with an optional logo 10 in the form of an insignia of a sports team or an advertisement or some other indicia as desired. The glove can be formed of any suitable material. For example, it can me constructed from a thin nylon knit fabric that is unisex and formed from breathable material.

The palm region 8 of each glove is provided with a sound piece in the form of hollow member 12 that extends upwardly from the surface of palm region 8.

Turning to FIG. 2, hollow member 12 is shown in greater detail and can be seen to comprise a generally domed shaped body portion 14 having an interior and exterior surface. The perimeter of hollow member 12 includes a flange member 16 which forms a surface for securing the hollow member 12 to the palm region 8 of holder 2.

Hollow member 12 is formed from a rigid material and in a preferred embodiment, an ABS plastic material. ABS materials provide sufficient rigidity for sound generation and impact resistance. Materials other than ABS plastic are within the scope of the present invention so long as the material selected is sufficiently rigid so that the desired sound is generated and impact resistant during use is provided.

As best shown in FIG. 2, the hollow member 12 is secured to the palm region 8 of each holder or glove by means of stitching 18 to the glove through flange member 16. FIG. 3 shows a further embodiment for securing the hollow member 12 to the palm region 8. In that embodiment, an adhesive 20 is disposed between the bottom surface of flange 16 and the fabric of the palm region 8. As is readily apparent, other methods for attaching the hollow member 12 to the holder 2 are within the scope of the present invention so long as the method selected provides a secure connection to the glove.

Once the holders 2 and 4 are secured to the hands of a user in the manner as illustrated earlier in FIG. 1, the user may then cause the palms of the hands to be rapidly brought together and in a clapping motion. Turning to FIG. 4, it can be seen that upon clapping, the dome shaped body portions 14 of each hollow member 12 are caused to impact against each other and a loud and distinct sound is generated which is greater in volume and of a higher pitch than that achievable by conventional hand clapping.

The smoothness and curvature of the dome shaped body portion 14 allows the respective hollow members 12 to slidingly engage so that rapid applause is possible and any contact between the two hollow members will result in the desired production of the enhanced sound.

While this invention has been described as having a preferred design, it is understood that it is capable of further modifications, and uses and/or adaptations following in general the principle of the invention and including such departures from the present disclosure as come within the known or customary practice in the art to which the invention pertains, and as may be applied to the central features hereinbefore set forth and within the scope of the invention.

What is claimed is:

1. A noisemaking device comprising:

a) first and second glove members for receiving a user's hand to enclose the same, each of said glove members having a palmward surface; and b) first and second bowl-shaped members, each of said first and second bowl-shaped members having a perimeter edge and a perimeter flange extending generally transversely from said perimeter edge, each of said first and second bowl-shaped members is immovably secured to a separate one of said glove members at said palmward surface to substantially cover the same wherein an interior chamber is formed between said first and second bowl-shaped members and said glove member palmward surfaces so that when said bowl-shaped members are caused to be impacted against each other during hand clapping, an enhanced clapping noise is produced.

2. A noisemaking device as in claim 1 and wherein said first and second glove members are constructed from fabric material.

3. A noisemaking device as in claim 1 and wherein each of said bowl-shaped members is provided with an interior and exterior surface, said interior surface is concave and said exterior convex.

4. A noisemaking device as in claim 3 and wherein said exterior surface is uniformly smooth.

5. A noisemaking device as in claim 1 and wherein said convex members are constructed from a hard plastic material.

6. A noisemaking device as in claim 5 and wherein said hard plastic material is an ABS plastic.

7. A noisemaking device as in claim 1 and wherein each of said first and second bowl-shaped members is secured to said respective one of said first and second glove members by one of stitching or an adhesive at said perimeter flange.

8. A noisemaking device as in claim 1 and wherein said glove members are fingerless.

9. A noisemaking device as in claim 1 and wherein said perimeter flange of said first and second bowl-shaped members extends the circumference of said first and second bowl-shaped members.

10. A noisemaking device as in claim 1 and wherein each of said bowl-shaped members is provided with an interior and an exterior surface that cooperate to form a wall.

11. A noisemaking device as in claim 1 and wherein said first and second bowl-shaped members are identical in size and shape.

12. A noisemaking device comprising:

a) first and second glove members, each of said first and second glove members having a palmward surface for enclosing the palm of a hand; and b) first and second convex disc members, each of said first and second convex disc members having a perimeter edge and a perimeter flange extending generally transversely from said perimeter edge each of said first and second convex disc members is secured at its perimeter flange to a separate one of said glove members to substantially cover the palmward surface thereof wherein each of said convex disc members has an interior and exterior surface, said interior surface is concave and said exterior surface is convex and a hollow chamber is formed between said convex disc member and said glove member to which it is secured whereby when said convex disc members are impacted against each other during hand clapping, an enhanced clapping noise is generated.

13. A noisemaking device as in claim 12 and wherein said convex disc members are constructed from a hard plastic material.

14. A noisemaking device as in claim 13 and wherein said perimeter flange extends entirely around said perimeter edge.

15. A noisemaking device as in claim 12 and wherein each of said first and second convex disc members is secured at said perimeter flange to said respective one of said first and second glove members by one of stitching or an adhesive.

16. A noisemaking device as in claim 12 and wherein said exterior surface is uniformly smooth.

17. A noisemaking device as in claim 12 and wherein said glove members are fingerless.

18. A noisemaking device as in claim 12 and wherein said first and second convex disc members are dome-shaped and non-rotatable.

* * * * *